US010588188B2

(12) United States Patent
Jozef et al.

(10) Patent No.: US 10,588,188 B2
(45) Date of Patent: Mar. 10, 2020

(54) ALTERNATING-CURRENT LED DRIVE CIRCUIT

(71) Applicant: SHANGHAI YAMING LIGHTING CO., LTD., Shanghai (CN)

(72) Inventors: Kryger De Jozef, Shanghai (CN); Xiaoliang Xu, Shanghai (CN)

(73) Assignee: SHANGHAI YAMING LIGHTING CO., LTD., Malu Town, Jiading District, Shanghai (CN)

( * ) Notice: Subject to any disclaimer, the term of this patent is extended or adjusted under 35 U.S.C. 154(b) by 945 days.

(21) Appl. No.: 15/102,530

(22) PCT Filed: Dec. 3, 2014

(86) PCT No.: PCT/CN2014/092866

§ 371 (c)(1),
(2) Date: Aug. 9, 2016

(87) PCT Pub. No.: WO2015/085881

PCT Pub. Date: Jun. 18, 2015

(65) Prior Publication Data

US 2019/0208594 A1 Jul. 4, 2019

(30) Foreign Application Priority Data

Dec. 9, 2013 (CN) ..... 2013 1 0665276

(51) Int. Cl.
*H05B 33/08* (2006.01)

(52) U.S. Cl.
CPC ..... *H05B 33/0824* (2013.01)

(58) Field of Classification Search
CPC ..... H05B 33/0815; H05B 33/0845; H05B 33/0842; H05B 33/0824
(Continued)

(56) References Cited

U.S. PATENT DOCUMENTS 7,719,209 B2 * 5/2010 Hayes ..... H05B 35/00 315/308
2011/0084619 A1 * 4/2011 Gray ..... H05B 33/0824 315/185 R

FOREIGN PATENT DOCUMENTS

CN 101668373 A 3/2010
CN 102045923 A 5/2011
(Continued)

*Primary Examiner* — Dedei K Hammond
*Assistant Examiner* — Amy X Yang
(74) *Attorney, Agent, or Firm* — Global IP Services; Tianhua Gu

(57) ABSTRACT

An alternating-current LED drive circuit, comprising a plurality of LED strings connected between an alternating-current voltage source and a ground, any one of the LED strings being correspondingly provided with a conversion switch and one or more LED light sources being connected in series in any one of the LED strings; a voltage detection unit used for detecting a voltage root mean square value of an alternating-current power supply signal in the connected alternating-current voltage source; and a switching logic control unit used for outputting, according to a voltage interval into which the voltage root mean square value detected by the voltage detection unit falls, a conversion control signal corresponding to the voltage interval to each conversion switch to corresponding to each LED string respectively control each conversion switch to perform a corresponding conversion action, the conversion action of each conversion switch enabling all LED strings to be connected in series or in parallel to adapt to the alternating-current voltage source.

6 Claims, 3 Drawing Sheets

(58) Field of Classification Search
USPC ..... 315/291
See application file for complete search history.

(56) References Cited

FOREIGN PATENT DOCUMENTS

| | | | |
|---|---|---|---|
| CN | 102811538 | A | 12/2012 |
| CN | 102858068 | A | 1/2013 |
| CN | 103249201 | A | 8/2013 |
| CN | 103298188 | A | 9/2013 |
| CN | 103619111 | A | 3/2014 |

* cited by examiner

ALTERNATING-CURRENT LED DRIVE CIRCUIT

CROSS REFERENCE TO RELATED PATENT APPLICATION

The present application is the US national stage of PCT/CN2014/092866 filed on Dec. 3, 2014, which claims the priority of the Chinese patent application No. 201310665276.7 filed on Dec. 9, 2013, which applications are incorporated herein by reference.

BACKGROUND OF THE PRESENT INVENTION

Field of Invention

The present invention relates to the field of LED illumination, in particular to an alternating-current LED drive circuit applicable to multiple voltage sources.

Description of Related Arts

With the enhancement of global environmental protection consciousness, in all countries around the world, especially in developed countries and regions, the application of environment-friendly light sources becomes increasingly popular, wherein a typical representative is LED technology. LED is an environment-friendly light source having advantages of high efficiency, energy saving and long light emitting lifetime, and has a great significance to environmental protection, energy saving and human health protection. With the continuous development and maturing of LED illumination technology, LED will be widely applied to various illumination fields and become a first choice of illumination tools in future.

At present, the major resistance which obstructs the LED illumination technology from being widely accepted by the market is the price of LED illumination systems. According to cost comparison and service life analysis results, compared with an LED illumination system driven by a switching power supply, an alternating-current driven LED illumination system has more outstanding advantages in aspects such as price and service life. Therefore, greatly developing the alternating-current driven LED illumination technology is a very powerful measure to reduce the price of LED illumination products and popularize LED illumination application.

The manufacturing process of the LED is developed quickly, and performance indexes such as efficiency and service life have already been increasingly mature. However, the development of drive power supplies still does not match. Manufacturing drive power supplies having the advantages of high efficiency, low cost, small size, long service life and high power factor is a guarantee of LED luminous quality and overall performance, and is a premise and an impetus for promoting wide application of LED illumination light sources to various illumination fields.

In an alternating-current driven LED illumination system, an LED drive circuit is connected with an alternating-current mains supply. Supposing that the drive circuit is a unit power factor, input current and input voltage are sine waves of the same phase. At this moment, input power is in a sine-squared form. However, the LED needs to be driven by constant current such that the luminous quality, service life and other performance indexes thereof can be better guaranteed. Therefore, constant current output needs to be realized, i.e., output power is constant. This will cause that the input power is not equal to a transient value of output power, and an additional element is needed to realize balancing between input power and output power. Most existing circuits use a high-capacity electrolytic capacitor as a power balancing element. However, the service life of the electrolytic capacitor is far shorter than the service life of the LED, and thus the service life of the electrolytic capacitor becomes a main factor which limits the overall service life of the LED drive circuit. In addition, the high-capacity electrolytic capacitor is large in size and heavy in weight, the size miniaturization of the LED drive circuit is limited and the power density of the drive circuit is decreased.

In view of this, the industry further provides an alternating-current high-voltage LED drive circuit, which has the features of high power factor and low total harmonic distortion. By using these features, the drive circuit can be applied to directly drive a (rectified) AC high-power LED load without using a smoothing capacitor or a switched-mode power supply conversion circuit. Therefore, the purposes of improving the reliability and decreasing the cost can be realized. However, this circuit can operate only at a single RMS (Root Mean Square) power supply voltage and cannot be applied to environments of multiple voltage sources, and consequently the application environment is limited.

SUMMARY OF THE PRESENT INVENTION

In view of the disadvantages of the prior art, the purpose of the present invention is to provide an alternating-current LED drive circuit, which is used for solving the problem that the LED drive circuit in the prior art can be only applied to an environment of single power supply voltage.

In order to realize the above-mentioned purposes and other related purposes, the present invention provides an alternating-current LED drive circuit, which comprises a plurality of LED strings connected between an alternating-current voltage source and ground, any one of the LED strings being correspondingly provided with a conversion switch and one or more LED light sources being connected in series in any one of the LED strings; a voltage detection unit used for detecting a voltage root mean square value of an alternating-current power supply signal in the connected alternating-current voltage source; and a switching logic control unit used for outputting, according to a voltage interval into which the voltage root mean square value detected by the voltage detection unit falls, a conversion control signal corresponding to the voltage interval to each conversion switch corresponding to each LED string respectively to control each conversion switch to perform a corresponding conversion action, the conversion action of each conversion switch enabling all LED strings to be connected in series or in parallel to adapt to the alternating-current voltage source.

Optionally, the number of the LED strings is two, the two LED strings are respectively a first LED string and a second LED string, the first LED string is correspondingly provided with a first conversion switch and the second LED string is correspondingly provided with a second conversion switch; the voltage interval corresponding to the voltage root mean square value of the alternating-current voltage signal comprises a high voltage interval and a low voltage interval; and the switching logic unit outputs, according to the voltage interval into which the voltage root mean square value detected by the voltage detection unit falls, the conversion control signal through a method comprising: if the voltage interval into which the voltage root mean square value detected by the voltage detection unit falls is the high voltage interval, outputting a conversion control signal to the first conversion switch corresponding to the first LED string and the second conversion switch corresponding to the second LED string to perform conversion actions to enable the first LED string and the second LED string to be connected in series; and if the voltage interval into which the voltage root mean square value detected by the voltage detection unit falls is the low voltage interval, outputting a conversion control signal to the first conversion switch corresponding to the first LED string and the second conversion switch corresponding to the second LED string to perform conversion actions to enable the first LED string and the second LED string to be connected in parallel.

Optionally, the first conversion switch is located between an output end of the first LED string and an input end of the second LED string; the second conversion switch is located between an input end of the first LED string and the input end of the second LED string, the input end of the first LED string is connected with the alternating-current voltage source and the output end of the first LED string and an output end of the second LED string are connected with the ground through a current source; if the voltage interval into which the voltage root mean square value detected by the voltage detection unit falls is the high voltage interval, the first conversion switch is converted to be on and the second conversion switch is converted to be off to enable the first LED string and the second LED string to be connected in series; and if the voltage interval into which the voltage root mean square value detected by the voltage detection unit falls is the low voltage interval, the first conversion switch is converted to be off and the second conversion switch is converted to be on to enable the first LED string and the second LED string to be connected in parallel.

Optionally, each LED string therein contains the same number of LED light sources, any one of the LED light sources is provided with a switching switch connected with the current source, and each switching switch is connected with the switching logic control unit and is controlled by the switching logic control unit according to a transient voltage value of the alternating-current power supply signal in the alternating-current voltage source.

Optionally, a current signal of the current source is increased or decreased based on reference voltage according to a number of the switching switches switched under the control of the switching logic control unit.

Optionally, the first conversion switch and the second conversion switch are NMOS transistors, and the correspondingly provided switching switch of each LED light source is a PMOS transistor.

Optionally, the high voltage interval is 240V±40V and the low voltage interval is 120V±20V.

As described above, the alternating-current LED drive circuit provided by the present invention has the following beneficial effects: the present invention breaks through the limitation that the traditional alternating-current LED drive circuit can operate only at single root mean square power supply voltage, and the alternating-current LED drive circuit is guaranteed to be applicable to the environment of multiple alternating-current voltage sources by providing a plurality of LED strings provided with the conversion switch between the alternating-current voltage source and the ground, and by controlling, according to the voltage interval into which the voltage root mean square value in the alternating-current power supply signal of the alternating-current voltage source falls, each conversion switch to perform the conversion action to enable all LED strings to be connected in series or in parallel to adapt the current voltage interval of the alternating-current voltage source.

DETAILED DESCRIPTION OF THE PREFERRED EMBODIMENTS

In view of that the application environment is limited since the alternating-current high-voltage LED drive circuit provided in the prior art can work only at single RMS power supply voltage, the inventor of the present invention makes an improvement to the prior art and provides an alternating-current LED drive circuit, which can adaptively adjust an electric connection mode of internal LED strings according to a voltage value of a current alternating-current voltage source, so as to adapt to an environment of multiple alternating-current voltage sources.

The embodiments of the present invention will be described below through specific examples. One skilled in the art can easily understand other advantages and effects of the present invention according to contents disclosed by the description. The present invention can be implemented or applied through other different specific embodiment, and various modifications or variations can also be made to various details in the description based on different points of view and applications without departing from the spirit of the present invention.

Please refer to the drawings. It needs to be stated that the drawings provided in the embodiments are just used for exemplarily describing the basic concept of the present invention, thus only illustrate components related to the present invention and are not drawn according to numbers, shapes and sizes of components during actual implementation, the pattern, number and scale of each component during actual implementation can be freely varied and the layout patterns of the components may be more complex.

The present invention will be described below in detail in combination with the embodiments and the drawings.

Figure 1:
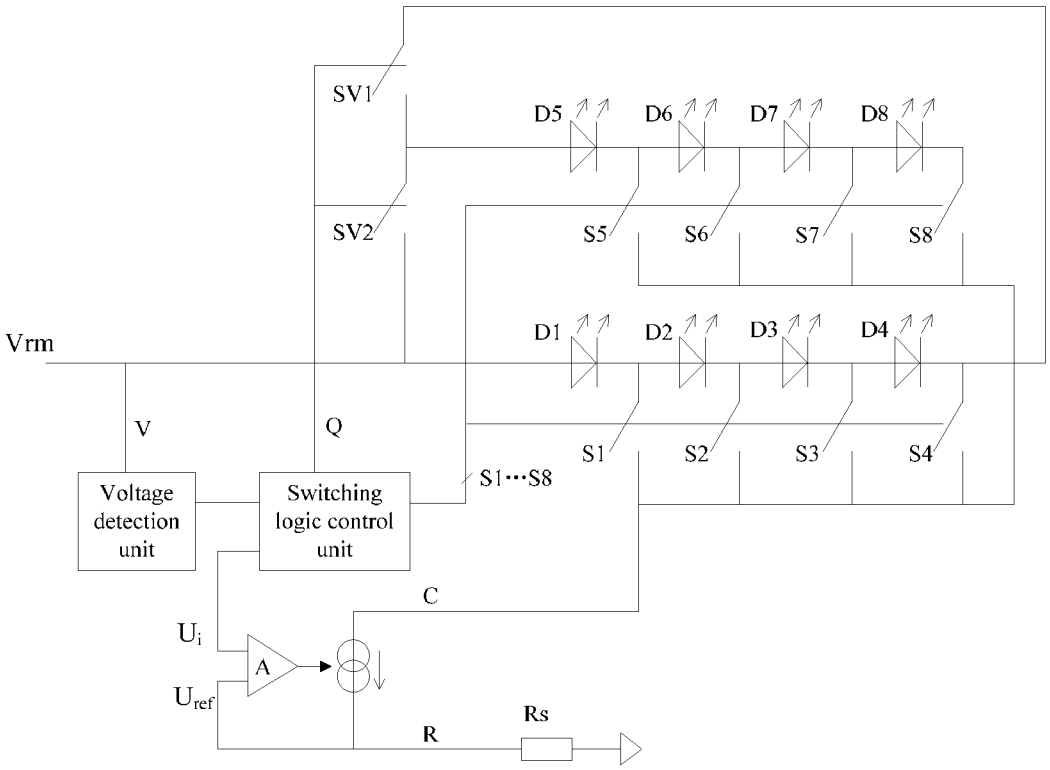
FIG. 1 is a principle schematic diagram of an alternating-current LED drive circuit in one embodiment of the present invention.

Please refer to FIG. 1, which is a principle schematic diagram of an alternating-current LED drive circuit in one embodiment of the present invention. As shown in FIG. 1, the alternating-current LED drive circuit in this embodiment comprises an alternating-current voltage source, an alternating-current current source, a plurality of LED strings, a voltage detection unit and a switching logic control unit.

Each of the above-mentioned components will be described below in detail.

The plurality of LED strings are connected between an alternating-current voltage source Vrm and ground, and any one of the LED strings therein comprises one or more LED light sources which are connected in series. In this embodiment, the number of the LED strings connected between the alternating-current voltage source Vrm and the ground is two, now the two LED strings are respectively recorded as a first LED string and a second LED string, an input end of the first LED string is connected with the alternating-current voltage source Vrm, and an output end of the first LED string and an output end of the second LED string are connected with the ground through the current source. The two LED strings therein contain the same number of LED light sources, and preferably each LED string therein comprises four LED light sources which are connected in series. The above-mentioned description is just exemplary. During actual application, the number of the LED strings and the number of the LED light sources connected in series in any one of the LED strings are not limited thereto, and can be differently selected for matching according to features of the actual alternating-current voltage source Vrm and the LED light sources.

In addition, for each LED string, any one of the LED strings is correspondingly provided with a conversion switch, and by using the conversion switch, the LED string corresponding to the conversion switch can be controlled to be on/off. In this embodiment, the number of the LED strings is two, and any one of the LED strings is provided with a conversion switch, i.e., the first LED string is correspondingly provided with a first conversion switch SV1, the second LED string is correspondingly provided with a second conversion switch SV2, and the first conversion switch SV1 and the second conversion switch SV2 both are connected with the switching logic control unit and are controlled by the switching logic control unit. More specifically, the first conversion switch SV1 is located between the output end of the first LED string and the input end of the second LED string, and the second conversion switch SV2 is located between the input end of the first LED string and the input end of the second LED string.

Further, for any one of the LED strings, any one of the LED light sources thereof is provided with a switching switch. Specifically, the first LED string comprises four LED light sources which are respectively marked as an LED light source D1, an LED light source D2, an LED light source D3 and an LED light source D4, wherein the LED light source D1 is provided with a switching switch S1, the switching switch S1 being located between the output end of the LED light source D1 and the current source; the LED light source D2 is provided with a switching switch S2, the switching switch S2 being located between the output end of the LED light source D2 and the current source; the LED light source D3 is provided with a switching switch S3, the switching switch S3 being located between the output end of the LED light source D3 and the current source; and the LED light source D4 is provided with a switching switch S4, the switching switch S4 being located between the output end of the LED light source D4 and the current source. Similarly, the second LED string comprises four LED light sources which are respectively marked as an LED light source D5, an LED light source D6, an LED light source D7 and an LED light source D8, wherein the LED light source D5 is provided with a switching switch S5, the switching switch S5 being located between the output end of the LED light source D5 and the current source; the LED light source D6 is provided with a switching switch S6, the switching switch S6 being located between the output end of the LED light source D6 and the current source; the LED light source D7 is provided with a switching switch S7, the switching switch S7 being located between the output end of the LED light source D7 and the current source; and the LED light source D8 is provided with a switching switch S8, the switching switch S8 being located between the output end of the LED light source D8 and the current source.

The voltage detection unit is connected with the alternating-current voltage source Vrm and the switching logic control unit, and is used for detecting a voltage root mean square value of an alternating-current power supply signal in the alternating-current voltage source Vrm, and transmitting the detected voltage root mean square value to the switching logic control unit. In this embodiment, voltage of the alternating-current voltage source Vrm is alternating-current voltage of a mains supply, wherein a voltage interval corresponding to the voltage root mean square value of the alternating-current voltage signal comprises a high voltage interval and a low voltage interval. Specifically, the high voltage interval is 240V±40V and the low voltage interval is 120V±20V.

The switching logic control unit is connected with the voltage detection unit and each conversion switch, and is used for outputting, according to the voltage interval into which the voltage root mean square value detected by the voltage detection unit falls, a conversion control signal corresponding to the voltage interval to each conversion switch to control each conversion switch to perform a corresponding conversion action. In this embodiment, the switching logic control unit is connected with the voltage detection unit, the first conversion switch SV1 and the second conversion switch SV2. Working principle of the switching logic control unit specifically comprises: if the voltage interval into which the voltage root mean square value detected by the voltage detection unit falls is the high voltage interval (e.g., 240V±40V), outputting a serial connection conversion control signal, the serial connection conversion control signal comprising converting the first conversion switch SV1 to be on and converting the second conversion switch SV2 to be off (i.e., the serial connection conversion control signal comprising a first on signal used for converting the first conversion switch SV1 to be on and a second off signal used for converting the second conversion switch SV2 to be off) to enable the first LED string and the second LED string to be connected in series; and if the voltage interval into which the voltage root mean square value detected by the voltage detection unit falls is the low voltage interval (e.g., 120V±20V), outputting a parallel connection conversion control signal, the parallel connection conversion control signal comprising converting the first conversion switch SV1 to be off and converting the second conversion switch SV2 to be on (i.e., the parallel connection conversion control signal comprising a first off signal used for converting the first conversion switch SV1 to be off and a second on signal used for converting the second conversion switch SV2 to be on) to enable the first LED string and the second LED string to be connected in parallel.

In addition, as described above, any one of the LED light sources in the LED strings is provided with a switching switch for connection with the current source. Therefore, the switching logic control unit is further connected with each switching switch and is used for controlling each switching switch to be on/off. Specifically, in this embodiment, the switching switch S1 corresponding to the LED light source D1, the switching switch S2 corresponding to the LED light source D2, the switching switch S3 corresponding to the LED light source D3 and the switching switch S4 corresponding to the LED light source D4 in the first LED string and the switching switch S5 corresponding to the LED light source D5, the switching switch S6 corresponding to the LED light source D6, the switching switch S7 corresponding to the LED light source D7 and the switching switch S8 corresponding to the LED light source D8 in the second LED string are all connected with the switching logic control unit. The switching logic control unit controls each switching switch to execute a switching action of turn-off or turn-on according to a transient voltage value of the alternating-current power supply signal in the alternating-current voltage source.

Further, the switching logic control unit is also connected with the current source. In this embodiment, a current signal of the current source is increased or decreased based on reference voltage according to a number of the switching switches (e.g., switching switches S1-S8) switched under the control of the switching logic control unit. Specifically, in this embodiment, a comparator A is provided, an input end thereof is connected with the output end of the switching logic control unit (output voltage $U_i$) and reference voltage $U_{ref}$. During actual application, if the number of the switching switches switched under the control of the switching logic control unit is larger and the output voltage $U_i$ of the switching logic control unit is greater than the reference voltage $U_{ref}$, the current source increases the signal of the current source; and if the number of the switching switches switched under the control of the switching logic control unit is larger and the output voltage $U_i$ of the switching logic control unit is less than the reference voltage $U_{ref}$, the current source decreases the signal of the current source.

Of course, the above-mentioned devices such as the voltage detection unit, the switching logic control unit, the comparator and the current source can be independent devices but are not limited thereto, and if necessary, the devices can be integrated in an integrated circuit.

When the alternating-current LED drive circuit provided by the invention as shown in FIG. 1 is applied, the voltage detection unit detects the voltage root mean square value of the alternating-current power supply signal in the connected alternating-current voltage source Vrm in real time and transmits information related to the detected voltage root mean square value to the switching logic control unit, and the switching logic control unit outputs the corresponding conversion control signal to each conversion switch according to the voltage interval into which the voltage root mean square value detected by the voltage detection unit falls, i.e., outputs the serial connection conversion control signal according to the high voltage interval and outputs the parallel connection conversion control signal according to the low voltage interval, such that each LED light source contained therein can normally work at the corresponding voltage interval.

Figure 2:
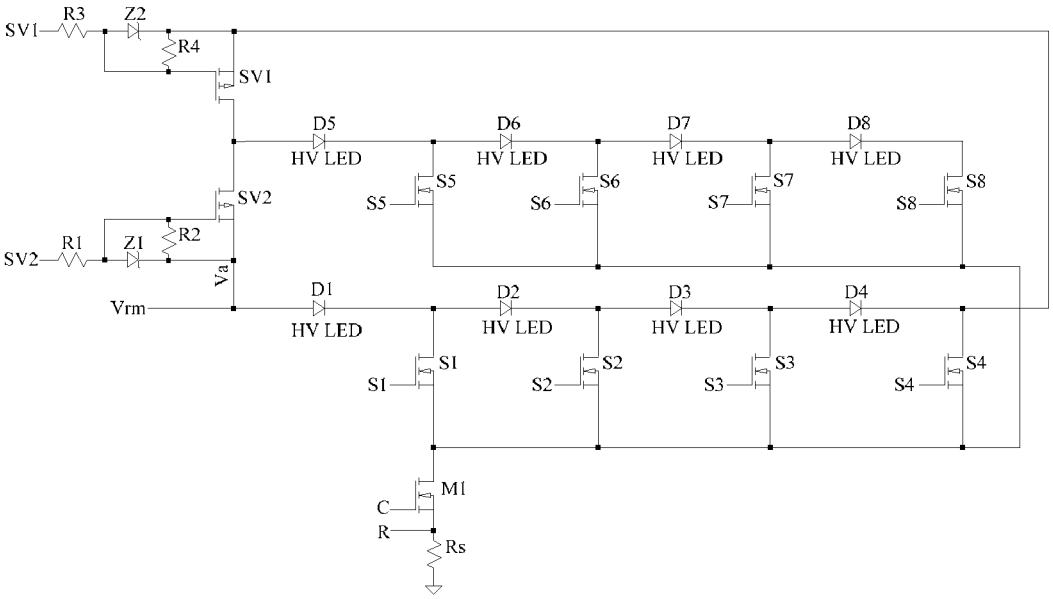
FIG. 2 is a circuit schematic diagram in one embodiment according to FIG. 1.

Please refer to FIG. 2, which is a circuit schematic diagram in one embodiment according to FIG. 1. As shown in FIG. 2, an alternating-current LED drive circuit of this embodiment comprises a first LED string, a second LED string, a first conversion switch SV1 and a conversion switch SV2 corresponding thereof, the first LED string therein comprises LED light sources D1, D2, D3 and D4, the LED light sources D1, D2, D3 and D4 are respectively provided with switching switches S1, S2, S3 and S4, the second LED string therein comprises LED light sources D5, D6, D7 and D8, and the LED light sources D5, D6, D7 and D8 are respectively provided with switching switches S5, S6, S7 and S8. Specifically, the first conversion switch SV1 and the second conversion switch SV2 both are NMOS transistors and each of the switching switch S1-S8 is a POMS transistor. By adopting the PMOS transistor for each of the switching switches S1-S8, compared with the NMOS transistor, more costs can be reduced. Through the first conversion switch SV1, the second conversion switch SV2 and each of the switching switches S1-S8, the first LED string and the second LED string can be connected in series when the voltage of the alternating-current voltage source is in a high voltage interval, and the first LED string and the second LED string can be connected in parallel when the voltage of the alternating-current voltage source is in a low voltage interval.

Figure 3:
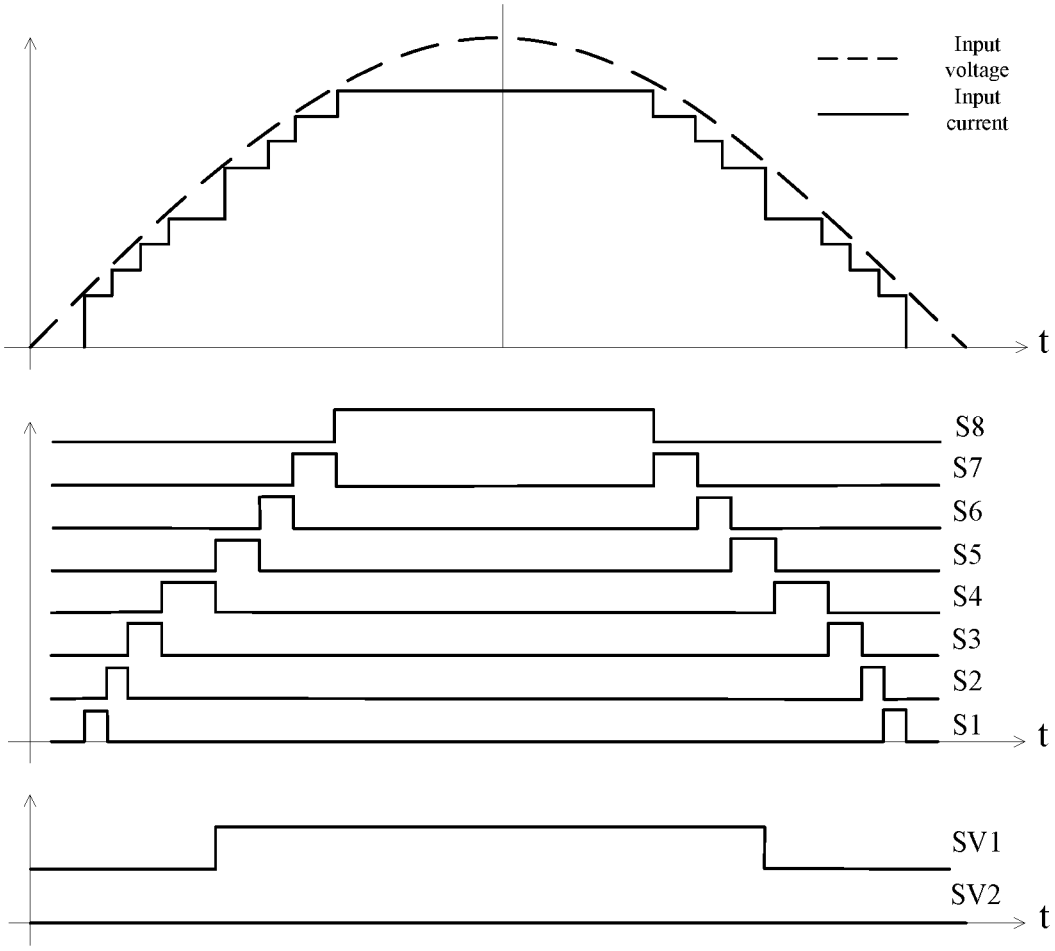
FIG. 3 is a sequence diagram of input voltage, input current, a first conversion switch, a second conversion switch and each switching switch under a situation that a first LED string and a second LED string are connected in series when voltage of an alternating-current voltage source is in a high voltage interval.

Please continuously refer to FIG. 3, which illustrates a sequence diagram of input voltage, input current, a first conversion switch SV1, a second conversion switch SV2 and each of the switching switches S1-S8 under a situation that a first LED string and a second LED string are connected in series when voltage of an alternating-current voltage source is in a high voltage interval (e.g., 240V±40V). According to FIG. 3, it can be seen that, in a serial operation mode, the first conversion switch SV1 is always in an on state, the second conversion switch SV2 is always in an off state and each of the switching switches S1-S8 are sequentially turned on.

Figure 4:
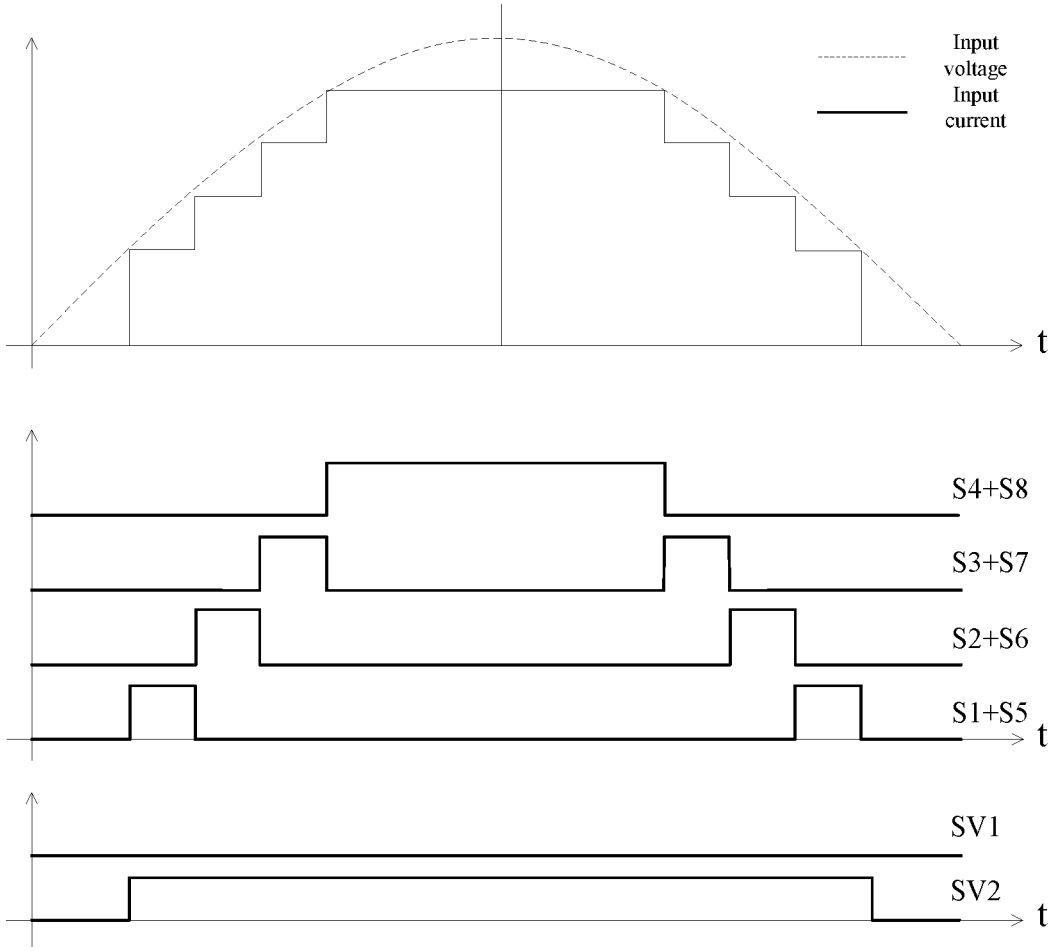
FIG. 4 is a sequence diagram of input voltage, input current, a first conversion switch, a second conversion switch and each switching switch under a situation that a first LED string and a second LED string are connected in parallel when voltage of an alternating-current voltage source is in a low voltage interval.

Please continuously refer to FIG. 4, which illustrates a sequence diagram of input voltage, input current, a first conversion switch, a second conversion switch and each of the switching switches under a situation that a first LED string and a second LED string are connected in parallel when voltage of an alternating-current voltage source is in a low voltage interval (e.g., 120V±20V). According to FIG. 4, it can be seen that, in a parallel operation mode, the first conversion switch SV1 is always in an off state, the second conversion switch SV2 is always in an on state, and the switching switches S1 and S5, S2 and S6, S3 and S7, and S4 and S8 are sequentially turned on.

To sum up, the alternating-current LED drive circuit provided by the present invention has the following beneficial effects: the present invention breaks through the limitation that the traditional alternating-current LED drive circuit can operate only at single root mean square power supply voltage, the alternating-current LED drive circuit is guaranteed to be applicable to the environment of multiple alternating-current voltage sources by providing the plurality of LED strings respectively provided with the conversion switch between the alternating-current voltage source and the ground, and by controlling, according to the voltage interval into which the voltage root mean square value in the alternating-current power supply signal of the alternating-current voltage source falls, each conversion switch to perform the conversion action to enable all LED strings to be connected in series or in parallel to adapt the current voltage interval of the alternating-current voltage source, and compared with the existing alternating-current LED drive circuit which can operate only at single RMS power supply voltage, the selectivity and the applicability are greater.

The above-mentioned embodiments are just used for exemplarily describing the principle and effects of the present invention instead of limiting the present invention. One skilled in the art can make modification or variation to the above-mentioned embodiments without going beyond the spirit and range of the present invention. Therefore, all equivalent modifications or variations made by those who have common knowledge in the technical field without departing from the spirit and technical concept disclosed by the present invention shall still be covered by the claims of the present invention.

What is claimed is:

1. An alternating-current LED drive circuit comprising:

a plurality of LED strings connected between an alternating-current voltage source and ground, any one of the LED strings being correspondingly provided with a conversion switch and one or more LED light sources being connected in series in any one of the LED strings;

a voltage detection unit used for detecting a voltage root mean square value of an alternating-current power supply signal in the connected alternating-current voltage source;

a switching logic control unit used for outputting, according to a voltage interval into which the voltage root mean square value detected by the voltage detection unit falls, a conversion control signal corresponding to the voltage interval to each conversion switch corresponding to each LED string respectively to control each conversion switch to perform a corresponding conversion action, the conversion action of each conversion switch enabling all LED strings to be connected in series or in parallel to adapt to the alternating-current voltage source;

one of the LED light sources is provided with a switching switch connected with the current source, and each switching switch is connected with the switching logic control unit and is controlled by the switching logic control unit according to a transient voltage value of the alternating-current power supply signal in the alternating-current voltage source; and a comparator is provided, an input end thereof is connected with the output end of the switching logic control unit with an output voltage $U_i$ and a reference voltage $U_{ref}$, when the number of the switching switches switched under the control of the switching logic control unit is larger and the output voltage $U_i$ of the switching logic control unit is greater than the reference voltage $U_{ref}$, the current source increases the signal of the current source; and when the number of the switching switches switched under the control of the switching logic control unit is larger and the output voltage $U_i$ of the switching logic control unit is less than the reference voltage $U_{ref}$, the current source decreases the signal of the current source.

2. The alternating-current LED drive circuit according to claim 1, wherein the number of the LED strings is two, the two LED strings are respectively a first LED string and a second LED string, the first LED string is correspondingly provided with a first conversion switch and the second LED string is correspondingly provided with a second conversion switch;

the voltage interval corresponding to the voltage root mean square value of the alternating-current voltage signal comprises a high voltage interval and a low voltage interval; and the switching logic unit outputs, according to the voltage interval into which the voltage root mean square value detected by the voltage detection unit falls, the conversion control signal through a method comprising: when the voltage interval into which the voltage root mean square value detected by the voltage detection unit falls is the high voltage interval, outputting a serial connection conversion control signal to the first conversion switch corresponding to the first LED string and the second conversion switch corresponding to the second LED string to perform conversion actions to enable the first LED string and the second LED string to be connected in series; and when the voltage interval into which the voltage root mean square value detected by the voltage detection unit falls is the low voltage interval, outputting a parallel connection conversion control signal to the first conversion switch corresponding to the first LED string and the second conversion switch corresponding to the second LED string to perform conversion actions to enable the first LED string and the second LED string to be connected in parallel.

3. The alternating-current LED drive circuit according to claim 2, wherein the first conversion switch is located between an output end of the first LED string and an input end of the second LED string; the second conversion switch is located between an input end of the first LED string and the input end of the second LED string, the input end of the first LED string is connected with the alternating-current voltage source and the output end of the first LED string and an output end of the second LED string are connected with the ground through a current source;

when the voltage interval into which the voltage root mean square value detected by the voltage detection unit falls is the high voltage interval, the serial connection conversion control signal comprises converting the first conversion switch to be on and converting the second conversion switch to be off to enable the first LED string and the second LED string to be connected in series; and when the voltage interval into which the voltage root mean square value detected by the voltage detection unit falls is the low voltage interval, the parallel connection conversion control signal comprises converting the first conversion switch to be off and converting the second conversion switch to be on to enable the first LED string and the second LED string to be connected in parallel.

4. The alternating-current LED drive circuit according to claim 3, wherein each LED string therein contains the same number of LED light sources.

5. The alternating-current LED drive circuit according to claim 4, wherein the first conversion switch and the second conversion switch are NMOS transistors, and the correspondingly provided switching switch of each LED light source is a PMOS transistor.

6. The alternating-current LED drive circuit according to claim 1, wherein the voltage interval is 240V±40V or the voltage interval is 120V±20V.

* * * * *